US008356692B1

(12) United States Patent
Steck et al.

(10) Patent No.: US 8,356,692 B1
(45) Date of Patent: Jan. 22, 2013

(54) RELEASE MECHANISM FOR HARNESS SYSTEM

(75) Inventors: Jeremy A. Steck, Salt Lake City, UT (US); Marco Tekelenburg, Zelienople, PA (US); Stewart Shannon, Pittsburgh, PA (US)

(73) Assignee: Mine Safety Appliances Company, Cranberry Township, PA (US)

( * ) Notice: Subject to any disclaimer, the term of this patent is extended or adjusted under 35 U.S.C. 154(b) by 0 days.

(21) Appl. No.: 13/435,175

(22) Filed: Mar. 30, 2012

Related U.S. Application Data

(60) Provisional application No. 61/611,773, filed on Mar. 16, 2012.

(51) Int. Cl.
*A45F 3/14* (2006.01)

(52) U.S. Cl. ..... 182/3; 182/4; 182/129; 224/262; 224/265; 224/628; 224/637

(58) Field of Classification Search ..... 182/3, 4, 182/129; 224/262, 265, 628, 637
See application file for complete search history.

(56) References Cited

U.S. PATENT DOCUMENTS

| | | | | | |
|---|---|---|---|---|---|
| 2,943,775 | A * | 7/1960 | Mack et al. | ..... | 224/628 |
| 3,033,431 | A * | 5/1962 | Henderson et al. | ..... | 224/604 |
| 3,090,205 | A * | 5/1963 | Hurwitz et al. | ..... | 405/186 |
| 3,174,129 | A * | 3/1965 | Laughlin et al. | ..... | 367/132 |
| 3,957,183 | A * | 5/1976 | Gadberry | ..... | 224/628 |
| 4,015,759 | A * | 4/1977 | Dreissigacker et al. | ..... | 224/262 |
| 4,049,164 | A * | 9/1977 | Sullivan et al. | ..... | 224/633 |
| 4,327,851 | A * | 5/1982 | Feathers | ..... | 224/634 |
| 5,131,576 | A * | 7/1992 | Turnipseed | ..... | 224/262 |
| 5,249,890 | A * | 10/1993 | Bergstrom | ..... | 405/186 |
| 5,607,258 | A * | 3/1997 | Eungard | ..... | 405/186 |
| 5,836,489 | A * | 11/1998 | Swetish | ..... | 224/262 |
| 6,091,331 | A * | 7/2000 | Toft et al. | ..... | 340/539.11 |
| 6,290,111 | B1 * | 9/2001 | Hedenberg et al. | ..... | 224/262 |
| 7,979,919 | B2 * | 7/2011 | Joran | ..... | 2/69 |
| 8,006,877 | B2 * | 8/2011 | Lowry et al. | ..... | 224/633 |
| 8,181,833 | B2 * | 5/2012 | Wangeby et al. | ..... | 224/627 |
| 2004/0140152 | A1 * | 7/2004 | Richardson | ..... | 182/3 |
| 2006/0011415 | A1 * | 1/2006 | Fischer et al. | ..... | 182/7 |
| 2009/0136301 | A1 * | 5/2009 | Carmichael | ..... | 405/186 |
| 2009/0159364 | A1 * | 6/2009 | O'Brien | ..... | 182/3 |
| 2011/0017546 | A1 * | 1/2011 | Nichols, Jr. | ..... | 182/3 |
| 2011/0179607 | A1 | 7/2011 | Colorado | | |
| 2011/0179608 | A1 * | 7/2011 | Colorado | ..... | 24/573.11 |
| 2012/0017406 | A1 | 1/2012 | Colorado | | |

* cited by examiner

*Primary Examiner* — Alvin Chin Shue
*Assistant Examiner* — Colleen M Chavchavadze
(74) *Attorney, Agent, or Firm* — Bartony & Associates, LLC

(57) ABSTRACT

A harness system includes a waist belt assembly, a first releasable retainer attached to the waist belt assembly, shoulder straps, a back plate connected to the shoulder straps, and a release system including at least a first release strap connected to and extending from the back plate. The first release strap includes at least a first releasable connector in operative connection with the first releasable retainer so that actuation of the first release strap causes disconnection of the first releasable connector from operative connection with the first releasable retainer so that the first releasable retainer becomes disconnected from connection with the back plate and the back plate can be removed by a user while the waist belt assembly remains worn by the user.

21 Claims, 8 Drawing Sheets

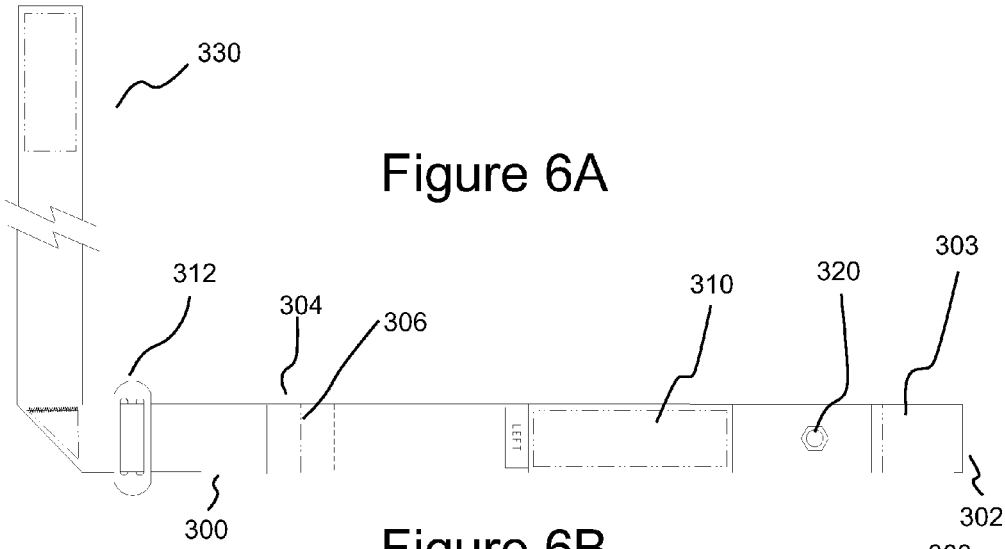
Figure 6A
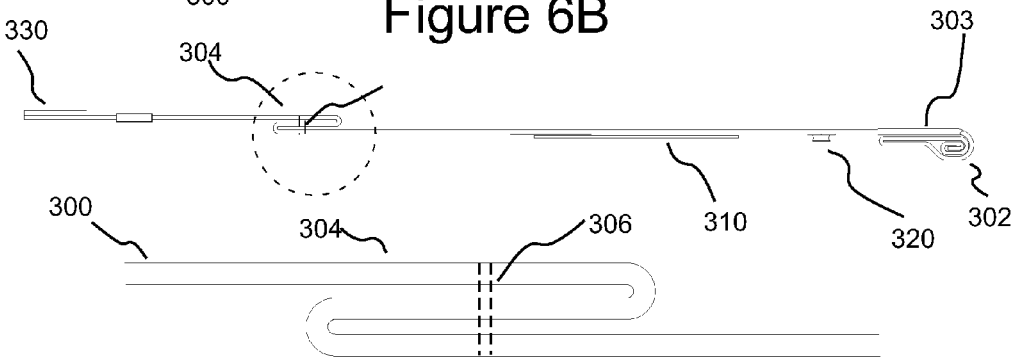
Figure 6B
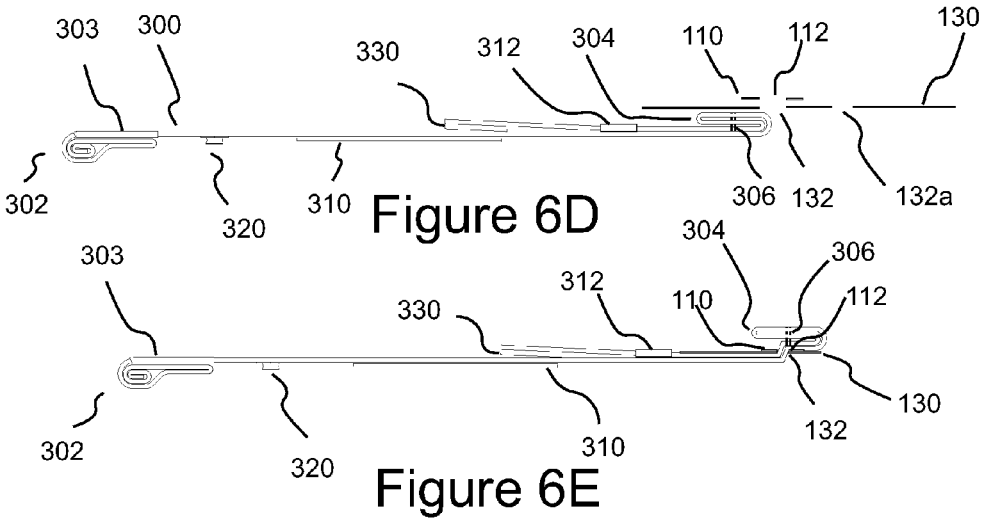
Figure 6C
Figure 6D
Figure 6E

Figure 6F
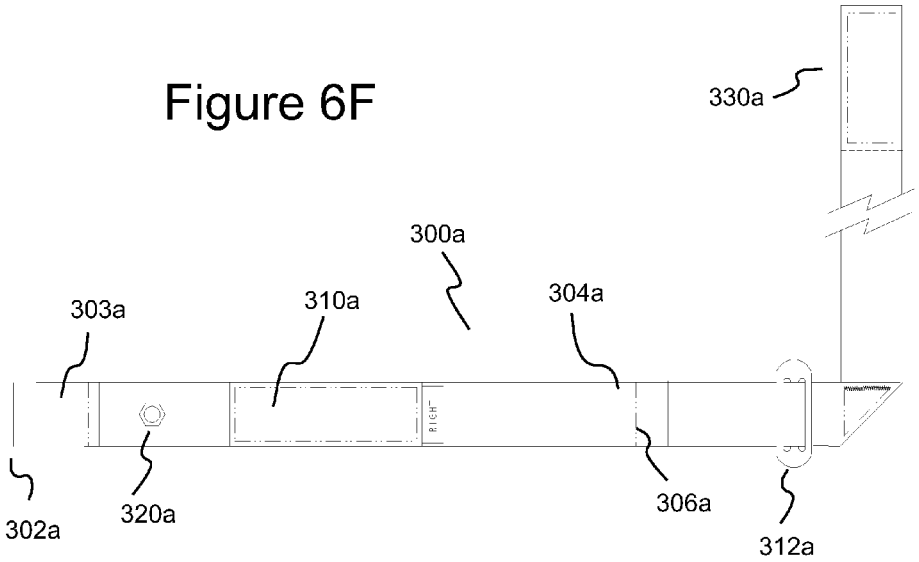
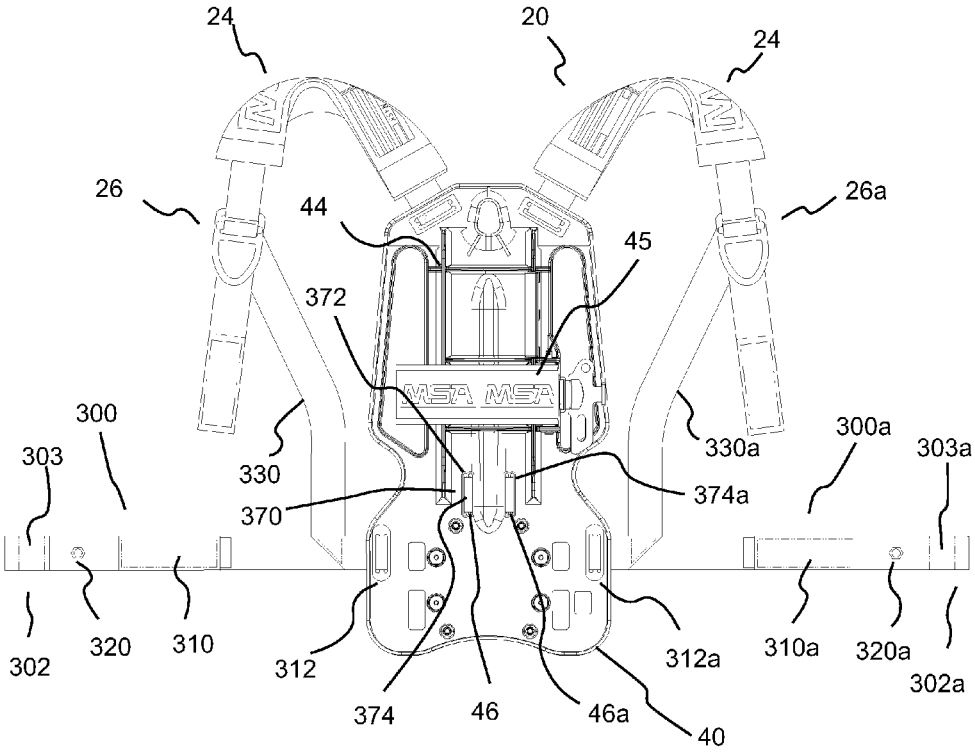
Figure 7

RELEASE MECHANISM FOR HARNESS SYSTEM

CROSS-REFERENCE TO RELATED APPLICATIONS

This application claims benefit of U.S. Provisional Patent Application No. 61/611,773, filed Mar. 16, 2012, the disclosure of which is incorporated herein by reference.

BACKGROUND OF THE INVENTION

The following information is provided to assist the reader to understand the invention disclosed below and the environment in which it will typically be used. The terms used herein are not intended to be limited to any particular narrow interpretation unless clearly stated otherwise in this document. References set forth herein may facilitate understanding of the present invention or the background of the present invention. The disclosure of all references cited herein are incorporated by reference.

Firefighters and other emergency responders often wear bulky protective outer garments to protect them from the heat and other dangers associated with fighting fires. The outer protective garments worn by firefighters are often referred to as turnout gear. The turnout gear may, for example, include a large coat, helmet, thick gloves, pants that have an outer layer and a removable inner liner. Firefighters also may wear an air tank that is typically part of a self-contained breathing apparatus or SCBA. An air tank of the SCBA is typically carried on the back of the firefighter via a harness. A firefighter or other emergency responder also typically wears a belt that may include various tools as well as an emergency descent system, which may include a descender and a support line as, for example, disclosed in U.S. Patent Application Publication No. 2006/0011415. The belt is often operatively connected to or integrated with the harness.

In an emergency situation such as the collapse of a building or a collapse of a floor of a building, a firefighter may be required to make a quick escape from very confined and dangerous quarters. However, the harness and air tank of an SCBA worn by a firefighter add substantial weight to the firefighter and increase the bulk of the firefighter. The increased weight and bulk can make escape (which may, for example, include a descent from a height) difficult.

SUMMARY OF THE INVENTION

In one aspect, a harness system includes a waist belt assembly, a first releasable retainer attached to the waist belt assembly, shoulder straps, a back plate connected to the shoulder straps, and a release system including at least a first release strap connected to and extending from the back plate. The first release strap includes at least a first releasable connector in operative connection with the first releasable retainer so that actuation of the first release strap causes disconnection of the first releasable connector from operative connection with the first releasable retainer so that the first releasable retainer becomes disconnected from connection with the back plate and the back plate can be removed by a user while the waist belt assembly remains worn by the user.

The first release strap may, for example, include a first section on one side of the first releasable connector. The first section of the first release strap may be connected to the back plate. The first release strap may further include a second section on the other side of the first releasable connector. The second section may be releasably connected to the waist belt assembly.

The second section of the first release strap may, for example, include a first fastener in the vicinity of an end of the first section of the first release strap connecting the first section of the first release strap to the waist belt assembly and a second fastener between the end of the first section of the first release strap and the first releasable connector connecting the first section of the first release strap to the waist belt assembly. In a number of embodiments, the first fastener requires application of force in a first direction by the user to the end of the first section of the first release strap to disconnect the first fastener from connection with the waist belt assembly, and the second fastener requires application of force in a second direction, different from the first direction, by the user to disconnect the second fastener from connection with the waist belt assembly. Each of the first fastener and the second fastener may, for example, be required to be disconnected from connection with the waist belt assembly before the first releasable connector can be disconnected from operative connection with the first releasable retainer.

In a number of embodiments, continued application of force in the second direction after disconnection of the second fastener from the waist belt assembly results in disconnection of the first releasable connector from operative connection with the first releasable retainer.

The second fastener may, for example, include a length of a hook-and-loop-type fastener on the first section of the first release strap which cooperates with a first length of hook-and-loop-type fastener on the waist belt assembly. A generally rearward force on the second section of the first release strap may be required to disconnect the second fastener from connection with the waist belt assembly.

The first releasable connector may, for example, be passed through a passage in the first releasable retainer to operatively connect the first releasable connector to the first releasable retainer and be pulled through the passage in the first releasable retainer in an opposite direction to disconnect the first releasable connector from operative connection with the first releasable retainer.

The first releasable connector may, for example, include a sewn fold in the first release strap. The first releasable retainer may, for example, include a first retainer strap attached at a first end thereof to the waist belt assembly, the first retainer strap being adapted to pass through a back plate connector connected to the back plate.

In a number of embodiments, the system further includes a second releasable retainer attached to the waist belt assembly and a second release strap connected to and extending from the back plate. The second release strap may, for example, include at least a second releasable connector in operative connection with the second releasable retainer so that actuation of the second release strap causes disconnection of the second releasable connector from operative connection with the second releasable retainer so that the second releasable retainer becomes disconnected from connection with the back plate, and the back plate can be removed by a user while the waist belt assembly remains worn by the user after disconnection of both the first releasable retainer and the second releasable retainer from connection with the back plate.

The system may further include a second releasable retainer attached to the waist belt assembly and a second release strap connected to and extending from the back plate. The second release strap may, for example, include at least a second releasable connector in operative connection with the second releasable retainer so that actuation of the second release strap causes disconnection of the second releasable connector from operative connection with the second releasable retainer so that the second releasable retainer becomes disconnected from connection with the back plate, and the back plate can be removed by a user while the waist belt assembly remains worn by the user after disconnection of both the first releasable retainer and the second releasable retainer from connection with the back plate.

The second release strap may, for example, include a first section on one side of the second releasable connector. The first section of the second release strap may be connected to the back plate. The second release strap may further include a second section on the other side of the second releasable connector. The second section of the second release strap may be releasably connected to the waist belt assembly.

The second section of the second release strap may, for example, include a first fastener in the vicinity of an end of the first section of the second release strap connecting the first section of the second release strap to the waist belt assembly and a second fastener between the end of the first section of the second release strap and the second releasable connector connecting the first section of the second release strap to the waist belt assembly. In a number of embodiments, the first fastener of the second release strap requires application of force in a first direction by the user to the end of the first section of the second release strap to disconnect the first fastener of the second release strap from connection with the waist belt assembly. In a number of embodiments, the second fastener of the second release strap requires application of force in a second direction, different from the first direction, by the user to disconnect the second fastener of the second release strap from connection with the waist belt assembly. Each of the first fastener of the second release strap and the second fastener of the second release strap may be required to be disconnected from connection with the waist belt assembly before the second releasable connector can be disconnected from operative connection with the second releasable retainer.

In a number of embodiments, continued application of force in the second direction after disconnection of the second fastener of the second release strap from the waist belt assembly results in disconnection of the second releasable connector from operative connection with the second releasable retainer. In a number of embodiments, the second fastener of the second release strap includes a length of a hook-and-loop-type fastener on the first section of the second release strap which cooperates with a second length of hook-and-loop-type fastener on the waist belt assembly. In such embodiments, a generally rearward force on the second section of the second release strap may, for example, be required to disconnect the second fastener of the second release strap from connection with the waist belt assembly.

The second releasable connector may, for example, be passed through a passage in the second releasable retainer to operatively connect the second releasable connector to the second releasable retainer and be pulled through the passage in the second releasable retainer in an opposite direction to disconnect the second releasable connector from operative connection with the second releasable retainer.

In a number of embodiments, the waist belt assembly further includes a descent system comprising a descent line stowed within the waist belt assembly. The back plate may, for example, be adapted to connect an SCBA air tank thereto. In a number of embodiments, the first release is positioned on a first side and the second release strap is positioned on a second, opposite side.

In another aspect a system includes a harness system comprising shoulder straps and a back plate connected to the shoulder straps, a waist belt assembly, a first releasable retainer attached to the waist belt assembly, and a release system including at least a first release strap including at least a first releasable connector in operative connection with the first releasable retainer so that actuation of the first release strap causes disconnection of the first releasable connector from operative connection with the first releasable retainer, so that the first releasable retainer becomes disconnected from connection with the back plate of the harness system, and the harness system can be removed by a user while the waist belt assembly remains worn by the user. The first release strap may further include a first fastener in the vicinity of an end of the first release strap connecting the first release strap to the waist belt assembly and a second fastener between the end of the first release strap and the first releasable connector connecting the first release strap to the waist belt assembly. The first fastener may, for example, require application of force in a first direction by the user to the end of the first release strap to disconnect the first fastener from connection with the waist belt assembly. The second fastener may require application of force in a second direction, different from the first direction, by the user to disconnect the second fastener from connection with the waist belt assembly. Each of the first fastener and the second fastener may, for example, be required to be disconnected from connection with the waist belt assembly before the first releasable connector can be disconnected from operative connection with the first releasable retainer.

In a number of embodiments, continued application of force in the second direction after disconnection of the second fastener from the waist belt assembly results in disconnection of the first releasable connector from operative connection with the first releasable retainer.

In a number of embodiments, the second fastener includes a length of a hook-and-loop-type fastener on the first release strap which cooperates with a first length of hook-and-loop-type fastener on the waist belt assembly. In such embodiments, a generally rearward force on the first release strap may, for example, be required to disconnect the second fastener from connection with the waist belt assembly.

The present invention, along with the attributes and attendant advantages thereof, will best be appreciated and understood in view of the following detailed description taken in conjunction with the accompanying drawings.

BRIEF DESCRIPTION OF THE DRAWINGS

FIG. 6A illustrates a rear view of a left-side release strap of the harness system of FIG. 1.

FIG. 6B illustrates a side view of the left-side release strap of the harness system of FIG. 1.

FIG. 6C illustrates an enlarged side view of the encircled portion of the left-side release strap of FIG. 6B.

FIG. 6D illustrates a side view of the left-side release strap of the harness system of FIG. 1 folded over upon itself in the region of the releasable connector thereof for connection to a retainer strap.

FIG. 6E illustrates a side view of the left-side release strap of the harness system of FIG. 1 folded over upon itself in the region of the releasable connector and connected to the retainer strap.

FIG. 6F illustrates a rear view of a right-side release strap of the harness system of FIG. 1.

FIG. 7 illustrates the harness system of the SCBA of FIG. 1 wherein the waist belt assembly has been removed from connection therewith and the release straps remain in connection with the harness system.

DETAILED DESCRIPTION OF THE INVENTION

As used herein and in the appended claims, the singular forms "a," "an", and "the" include plural references unless the content clearly dictates otherwise. Thus, for example, reference to "a connector" includes a plurality of such connectors and equivalents thereof known to those skilled in the art, and so forth, and reference to "the connector" is a reference to one or more such connectors and equivalents thereof known to those skilled in the art, and so forth.

Because a harness system and any equipment associated therewith (for example, a back plate and air tank of an SCBA worn by a firefighter) add substantial weight and bulk, it would be desirable if firefighters and/or other emergency responders had the ability to relatively quickly remove the harness system and associated equipment, without removing a waist belt operatively connected to the harness system. As discussed above, such waist belts may have attached tools that may be very useful in an escape, including, for example, an emergency descent system. Several embodiments of harness systems with release mechanisms and methods of using them are discussed in connection with an SCBA. However, one skilled in the art will appreciate that the harness systems and release mechanisms hereof can be used in connection with many types of harnesses operatively connected to belts.

Figure 1:
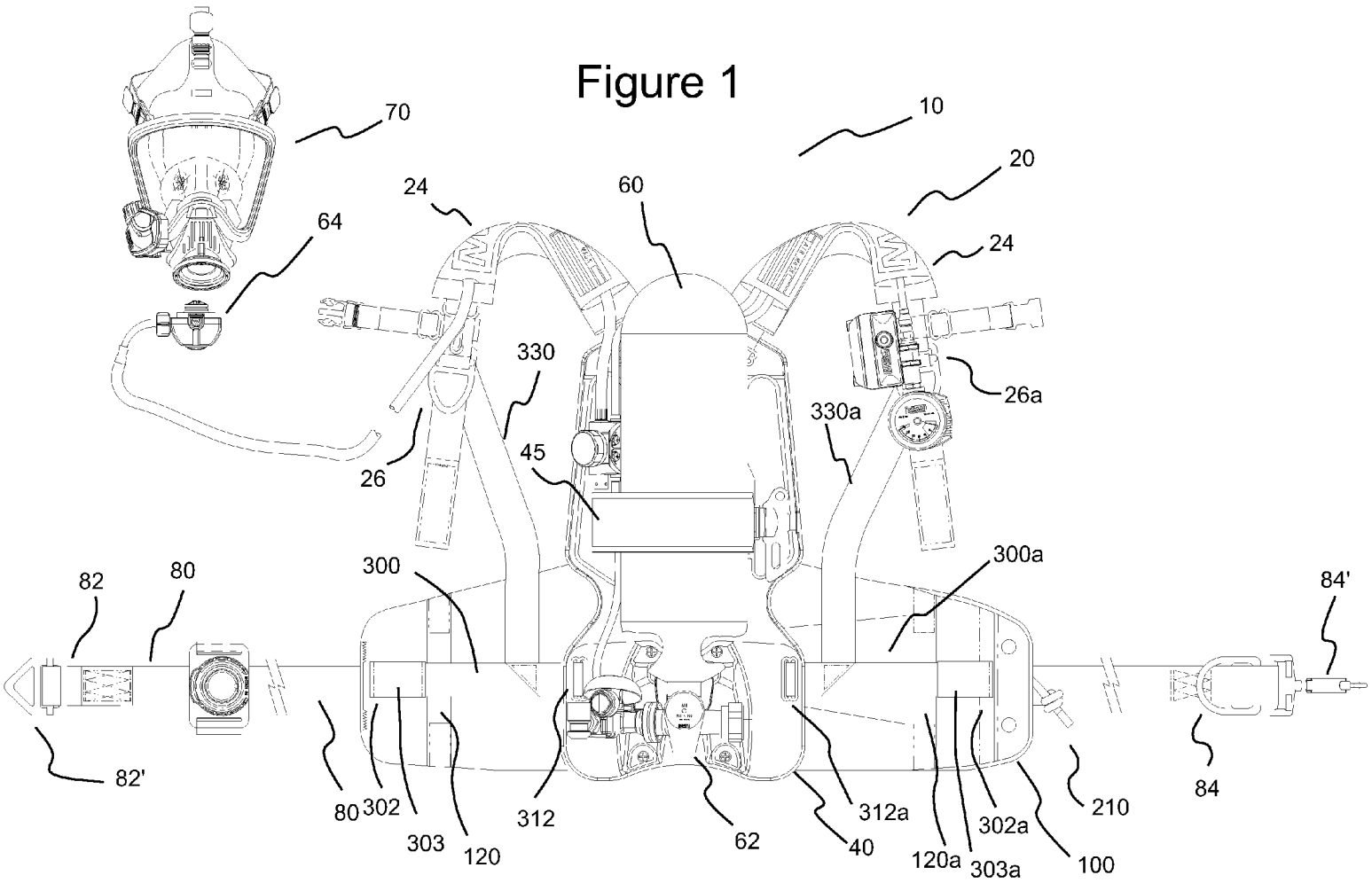
FIG. 1 illustrates a rear view of an embodiment of a self-contained breathing apparatus or "SCBA" with a harness system having an embodiment of a release mechanism hereof.

A self-contained breathing apparatus or SCBA is a system used to enable breathing in environments which are immediately dangerous to life and health (IDLH). For example, firefighters wear an SCBA when fighting a fire. An embodiment of an SCBA system or SCBA 10 is illustrated in FIG. 1. SCBA 10 includes a harness or harness system 20, which includes a support or back plate 40 to support one or more air tanks 60. As use herein, the term "back plate" refers to a relatively rigid support member to which an item such as an air tank of an SCBA may be attached. Back plate 40 may, for example, include a frame 44 to support and position air tank 60. Air tank 60 is placed in fluid connection with a facepiece 70. Air tank 60 typically contains air or other oxygen-containing gas under high pressure (2200 psi-4500 psi) and is connected to a first stage regulator 62 which reduces the pressure to about 80 psi. SCBA 10 further includes a second stage regulator 64 that has an inlet valve which controls the flow of air for breathing between air tank 60 and facepiece 70. Typically, the inlet valve controls the flow of air through second state regulator 64 in response to the respiration of the user.

Figure 2A:
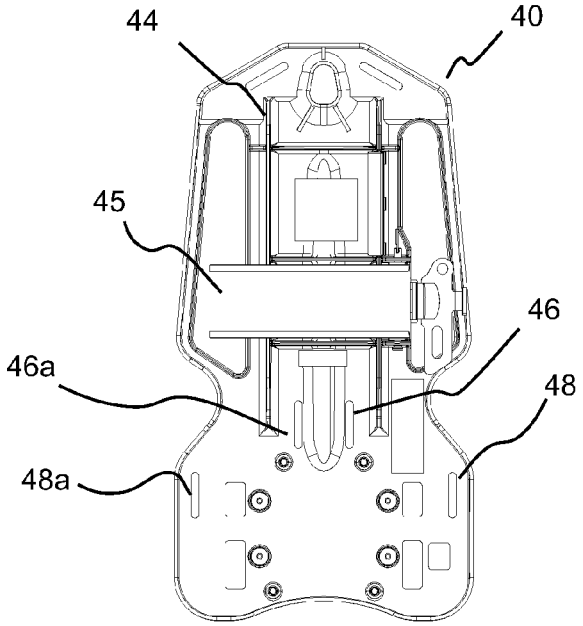
FIG. 2A illustrates a front view of a back plate of the SCBA of FIG. 1.
Figure 2B:
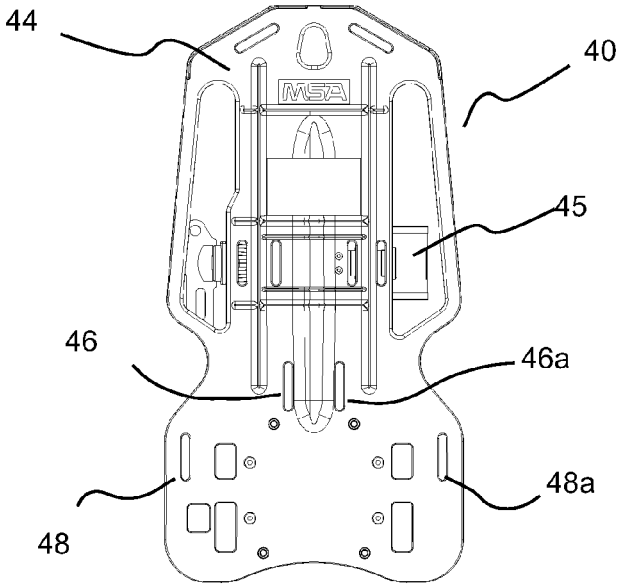
FIG. 2B illustrates a rear view of a back plate of the SCBA of FIG. 1.
Figure 3:
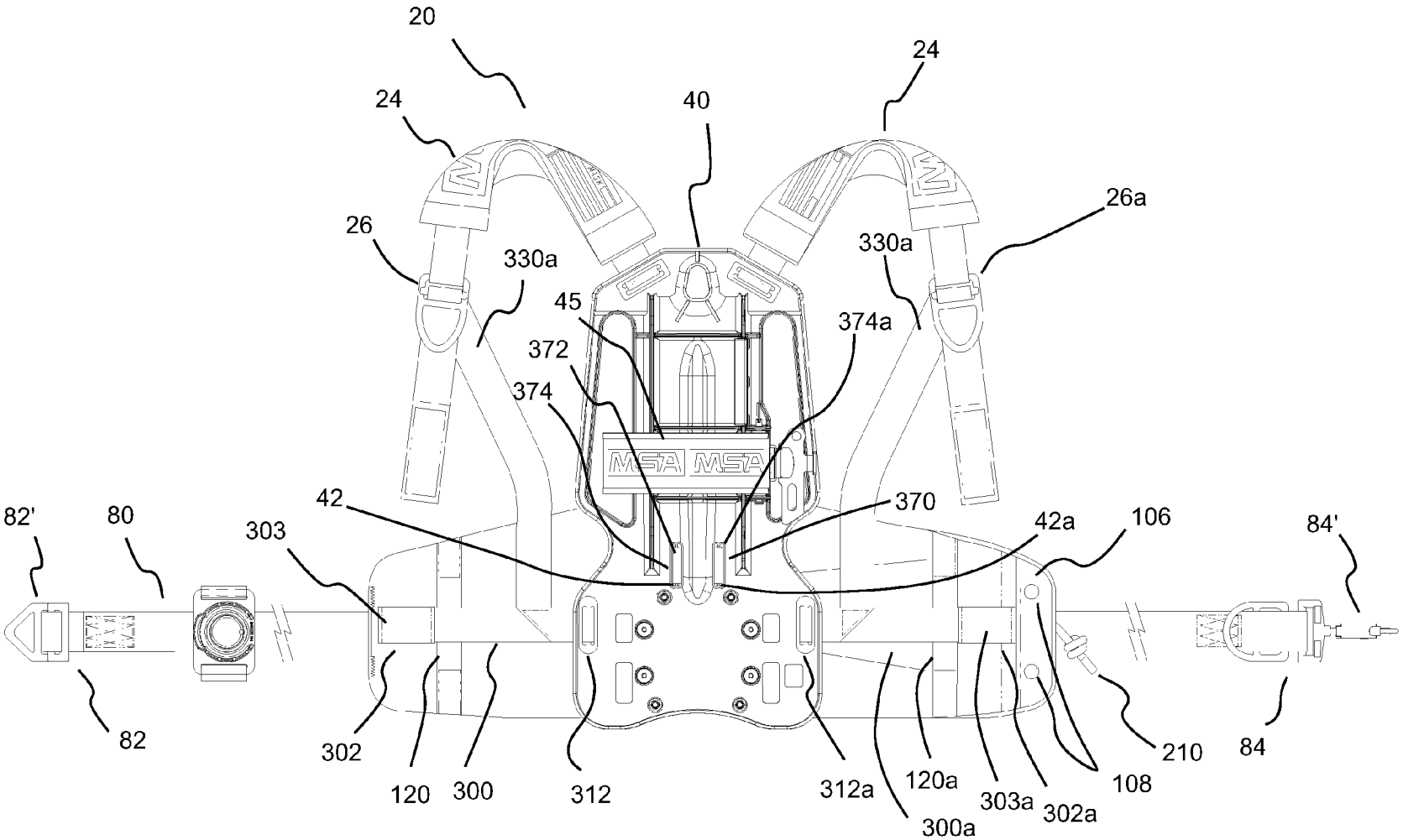
FIG. 3 illustrates a rear view of the harness system of the SCBA of FIG. 1.
Figure 4:
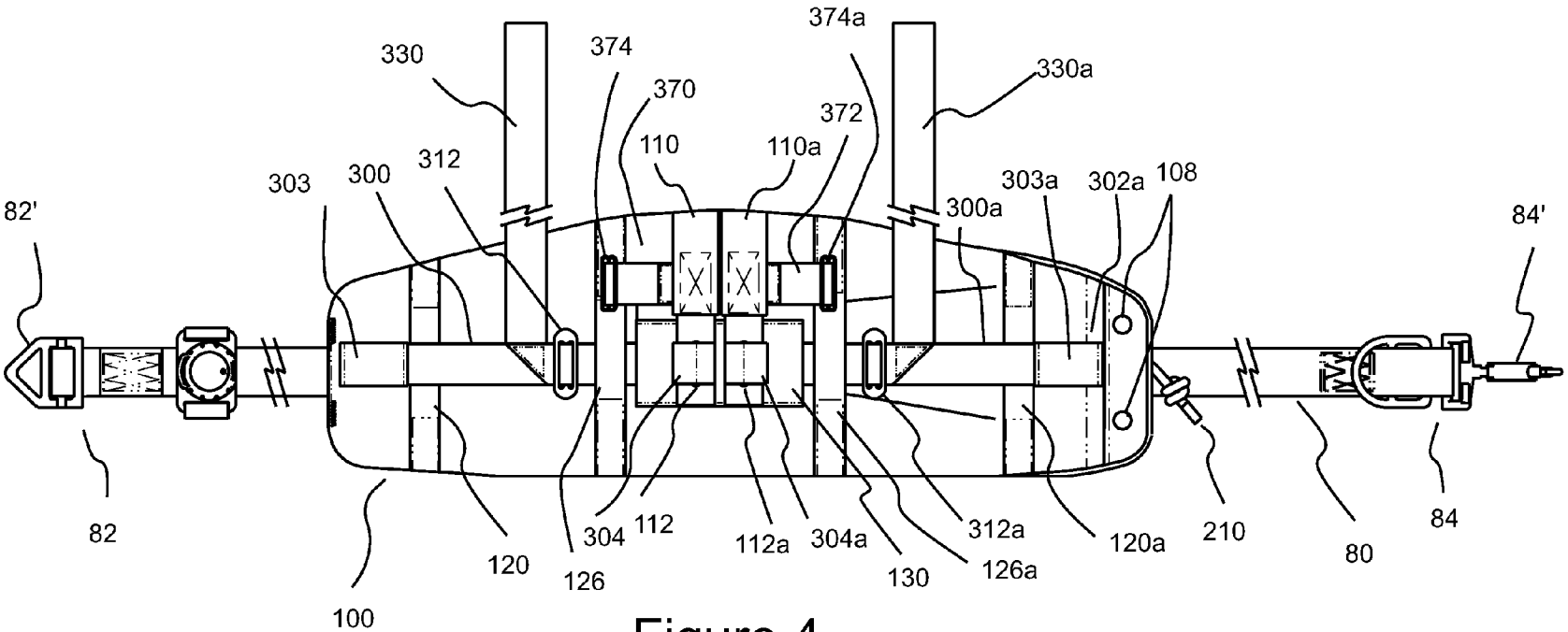
FIG. 4 illustrates a rear view of the waist belt assembly of the harness system, including the waist belt and support pad, of FIG. 1 detached from the back plate of the SCBA.

Back plate 40 may, for example, include a frame 44 (see, for example, FIG. 2A) that is dimensioned and configured to hold or retain air tank 60. Frame 44 may, for example, be in operative connection with one or more retaining members 45 which pass around air tank 60 to retain tank 60 in connection with back plate 40. Shoulder straps 24 are attached to back plate 40. The user may pass his or her arms through shoulder straps 24 to position back plate 40 against or adjacent to the user's back.

In the illustrated embodiment, harness 20 includes or is operatively connected to a waist belt 80. Among other functions, waist belt 80 assists in maintaining the lower portion of back plate 40 adjacent to the user's back. As known in the art, waist belt 80 includes a first end 82 and a second end 84 that are releasably connectable around the waist of the user. First end 82 may, for example, have attached thereto a first connector 82' such as a D-ring or V-ring, and second end 84 may, for example, have attached thereto a second, cooperating connector 84' such as a carabiner or snap hook. As clear to one skilled in the art, many other types of cooperating connectors may be used in connection with waist belt 80.

In the illustrated embodiment, waist belt 80 is connected to, passes through or is integrated with a support pad 100, which may, for example, be a lumbar support pad. Support pad 100 may, for example, include a channel 102 (see, FIG. 5, in which channel 102 is illustrated in broken lines) that is dimensioned to pass waist belt 80 therethrough to form a waist belt assembly including support pad 100 and waist belt 80. No connector is required to form the operative cooperation between waist belt 80 and support pad 100. Support pad 100 may, for example, include a foam or other cushioning or energy absorbing material, which is encased by a fire resistant material.

Figure 8:
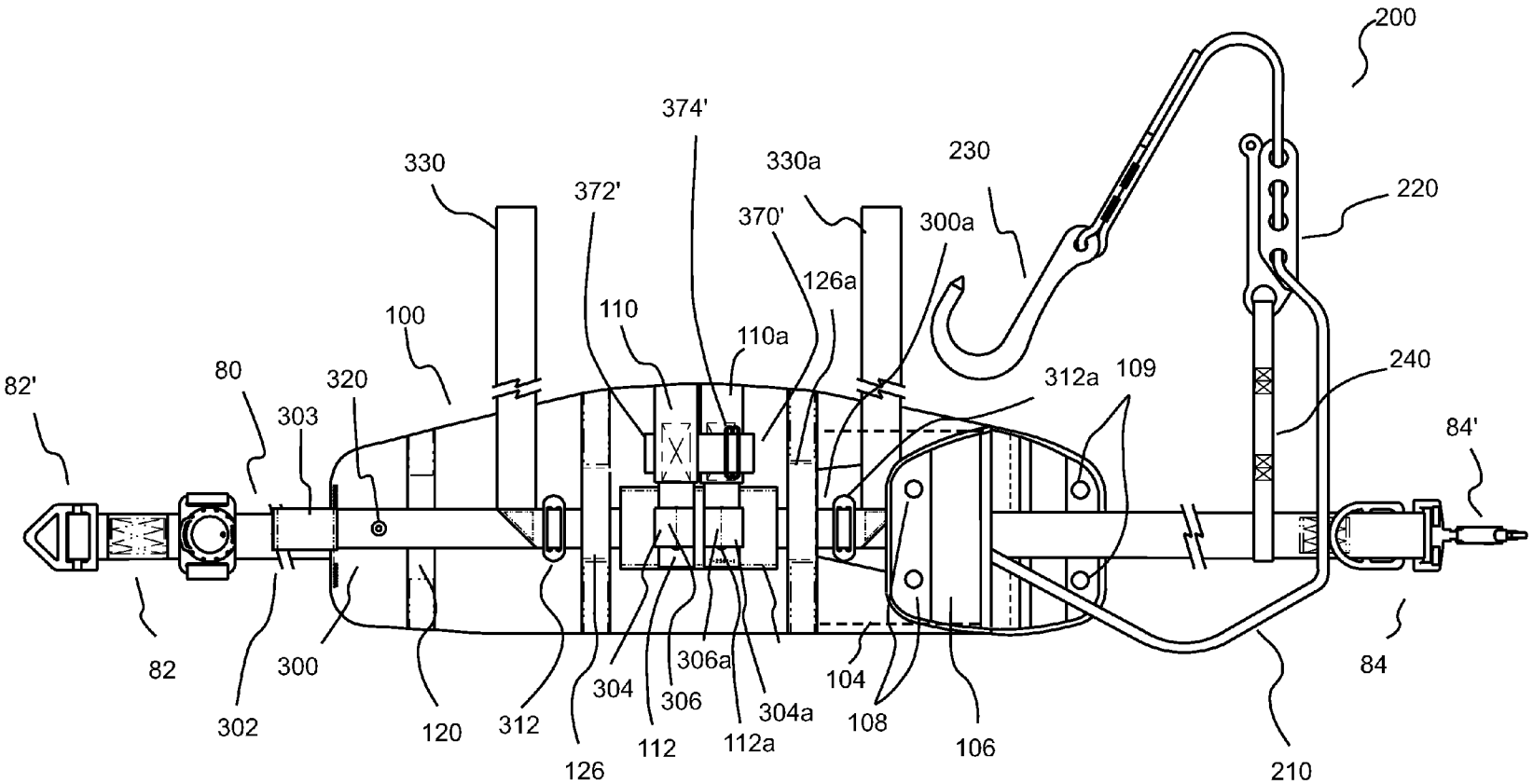
FIG. 8 illustrates a rear view of the waist belt assembly including an alternative connector for connecting to the back plate of the SCBA and wherein a descent system in illustrated in greater detail.

As, for example, illustrated in FIG. 8, a descent system 200 can be placed in operative connection with waist belt 80 of the waist belt assembly in a manner similar to that discussed in U.S. Patent Application Publication No. 2006/0011415. Descent system 200 may, for example, include a support line 210, in operative connection at a first end thereof with waist belt 80. Support line 210 passes through a descender 220 and includes an anchor connector 230 attached to a second end thereof. Descender 220 may, for example, be attached to waist belt 80 via a shock absorber 240. In the illustrated embodiment, support line 210 is stored or stowed within a pouch 104 (see FIG. 8, in which pouch 104 is illustrated in broken lines) within support pad 100. In the illustrated embodiment, pouch 104 is accessible via a flap 106, which is openable and closable via cooperating connectors 108 and 109 (for example, snap connectors). Support line 210 may be deployed from pouch 104 of support pad 100 for use in descending from a height as, for example, discussed in U.S. Patent Application Publication No. 2006/0011415.

Waist belt 80 is connected to back plate 40 via a release system that enables waist belt 80 to be released from connection with back plate 40 in a ready and relatively quick manner without removing waist belt 80 from the user. In the illustrated embodiments, the waist belt assembly including support pad 100 and waist belt 80 is connected to back plate 40 via a release system that enables the assembly of support pad 100 and waist belt 80 to be released from connection with back plate 40 in a ready and relatively quick manner. Although, a number of embodiments are discussed herein for release of a waist belt assembly including support pad 100 and waist belt 80 wherein retainer straps and/or other elements of a release system as described herein are attached to support pad 100, one skilled in the art appreciates that a release system as described herein can be used in connection with a waist belt alone by, for example, attaching various elements of the release system directly to the waist belt. The term "waist belt assembly" as used herein includes a waist belt including various retainer straps and/or other elements of a release system as described herein.

The release system may, for example, include one or more release elements (for example, release or pull straps) that are actuatable by the user. In a number of embodiments, the one or more release elements are connected to back plate 40 and extend therefrom. In a number of embodiments, at least two different actions or types of actions are required by the user to effect release of each of the one or more release elements. Requiring two or more separate and different actions to effect release assists in preventing unintentional or accidental release. One type of action required to effect release may, for example, be limited to application of a force in a specified direction to, for example, assist in preventing unintentional release (for example, in the case of snagging etc.)

A release system including two release or pull straps 300 and 300*a*, which operate in a generally identical but reciprocal manner, is described in connection with FIGS. 1 through 8. Release straps 300 and 300*a* can, for example, be formed from a length of webbing material woven from, for example, a polymeric material such as nylon and/or other polymers. First and second release straps 300 and 300*a*, respectively, each have one or more portions that maintain a connection between support pad 100 of the waist belt assembly and back plate 40, either directly or through an intermediate connector or connection system. In the illustrated embodiment, two retainers or retainer straps 110 and 110*a* are attached to support pad 100, by, for example, sewing an end thereof the top of support pad 100. As used herein, positional terms such as "top", "bottom", "left", "right", "lateral", "forward", "rearward" etc. refer to an orientation of harness system 20 and components thereof when worn by a user.

In the illustrated embodiments, retainer strap 110 cooperates with release strap 300 and retainer strap 110*a* cooperates with release strap 300*a* to maintain a connection between retainer straps 110 and 110*a* and a connector system 370 which connects to back plate 40. In the illustrated embodiment, connector system 370 includes a strap 372 having connectors 374 and 374*a* at each end thereof. Connectors 374 and 374*a* are, for example, tri-bar buckle elements which cooperate with slots 46 and 46*a* in back plate 40 in manner similar to a mating buckle. In that regard, connectors 374 and 374*a* operate as male members, while slots 46 and 46*a* and the surrounding portions of back plate 40 operate as female members. Slots 46 and 46*a* provide openings that allows connectors 374 and 374*a*, while oriented over a range of positions approximately or generally perpendicular to the planes of slots 46 and 46*a* and angled with respect to the orientation of slots 46 and 46*a*, to pass therethrough. After connection, it is difficult to effect disconnection unless one manually reorients connectors 374 and 374*a* and slides connectors 374 and 374*a* back through slots 46 and 46*a*. During use, when connector system 370 is connected to back plate 40 by connectors 374 and 374*a* and intermediate strap 372, forces upon connector system 370 prevent connectors 374 and 374*a* from reorienting to a position in which they can be removed from connection with slots 46 and 46*a*, respectively (see, for example, FIG. 3).

In the illustrated embodiments, first (or left side) retainer strap 110 extends from the top of support pad 100 to cooperate or interconnect with a first releasable connector 304 in operative connection with first (or left side) release strap 300. In a number of embodiments, first releasable connector 304 includes a sewn (or otherwise connected) fold in first release strap 300 as, for example, illustrated in FIGS. 6A through 6E. In other embodiments, a releasable connector can be attached to first release strap 300. The fold of first releasable connector 304 may, for example, be maintained in first release strap 300 via sewing or stitching 306. A slot 112 may, for example, be formed in first retainer strap 110 to releasably receive first releasable connector 304. Second (or right side) retainer strap 110*a* is formed in generally the same manner as first retainer strap 110 and like components thereof are number similarly with the addition of the designation "a". Likewise, second (or right side) release strap 300*a* is formed in generally the same manner as first release strap 300 and like components thereof are number similarly with the addition of the designation "a".

Figure 5:
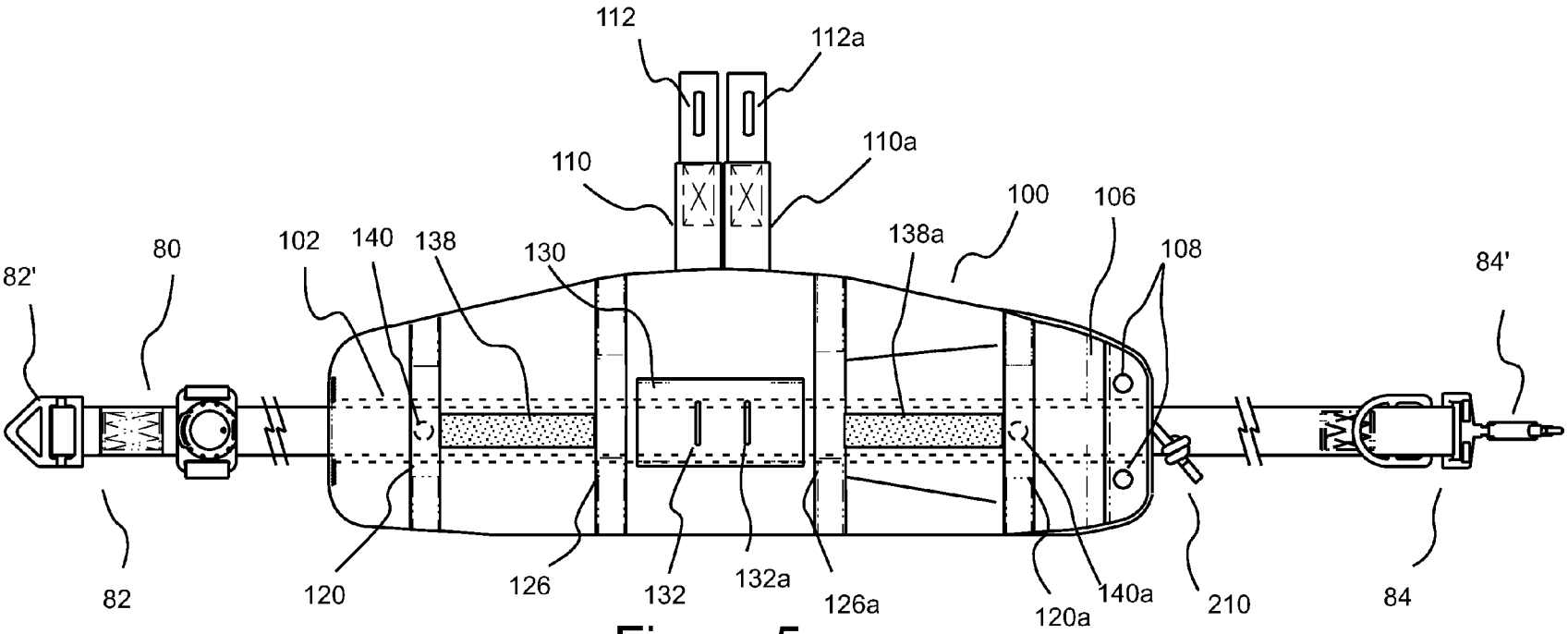
FIG. 5 illustrates a rear view of the waist belt assembly of the SCBA of FIG. 1 detached from the back plate of the SCBA, wherein the release straps have been removed from connection with the waist belt assembly.

As, for example, illustrated in FIG. 5, support pad 100 includes a first or laterally outward loop 120 on a left side thereof formed, for example, by sewing a length of a webbing material to the rear surface of support pad 100 in a manner to form a loop or passage between support pad 100 and the webbing material. Support pad further includes a second or laterally inward loop 126 on the left side thereof which may also be formed by sewing a length of a webbing material to the rear surface of support pad 100. Support pad 100 further includes a relatively stiff member or plate 130 which is positioned generally centrally thereon. In several embodiments, member 130 was formed from fire-resistant NOMEX® (a poly(isophthaloylchlorid/m-phenyenediamine polymer fiber material available from DuPont of Wilmington, Del.). Member 130 may, for example, be attached to support pad 100 via, for example, stitching at an upper and lower end thereof to from a passage or channel between a rear surface of support pad 100 and member 130. Member 130 further includes a first or left passage or slot 132 formed therein and a second or right passage or slot 132*a* formed therein. In the illustrated embodiment, support pad 100 was formed generally symmetrically in a number of respects and included a first or laterally outward loop 120*a* on the side thereof and a second or laterally inward loop 126*a* on the right side thereof.

To install first release strap 300 in connection with support pad 100, support pad 100 is first placed in the position illustrated in FIG. 5. First or left release strap 300 is then oriented as shown in FIGS. 6A and 6B. The webbing of first release strap 300 is then folded over itself, for example, at a point between an extending length of a hook-and-loop type fastener 310 (for example, VELCRO®, available from Velcro USA Inc. of Manchester, N.H.) and the sewn fold of connector 304 such that hook-and-loop type fastener faces the rearward surface of support pad 100 (see FIG. 6D). Releasable connector 304 divides release strap 300 into a first section extending from releasable connector 304 to a first end 302 of release strap 300 and a second section extending from releasable connector 304 to a second end 330 of release strap 300. The first section is thus on one side of releasable connector 304 and the second section is on the other side of releasable connector 304. The folded webbing of first release strap 300 is then passed under the second loop 126 on the left side of support pad 100 (see FIG. 6D). The folded webbing of first release strap 300 is then routed between member 130 and out through left slot 132 in member 130. The installer continues to pull the webbing of first release strap 300 through left slot 132 until the sewn fold of releasable connector 304 is pulled completely through slot 132 (see, for example, FIG. 6E).

After the sewn fold of releasable connector 304 is pulled completely through slot 132, first retainer strap 110 is folded over support pad 100 to position slot 112 in the vicinity of connector 304. The folded webbing of first release strap 300 is passed through slot 112 until the sewn fold of releasable connector 304 completely passes through slot 112 (see, for example, FIGS. 6E and 8). At this point, a back plate connector 312 (for example, a tri-bar buckle), which is attached to the second section of first release strap 300, is pulled to the left until the sewn fold of releasable connector 304 is pulled tightly against slot 132 of member 130. The length of first section of first release strap 300 (folded underneath back plate connector 312 of the second section and on the opposite side of the sewn fold of releasable connector 304) is then pulled to the left (see, for example, FIG. 8) until any slack in the webbing of the first section has been pulled tightly against the sewn fold. Care should be taken in this action to not pull the sewn fold of releasable connector 304 through slot 112.

Extending hook-an-loop type fastener 310 is mated or connected with a cooperating hook-and-loop type fastener 138 (see FIG. 5) on support pad 100. Subsequently, a fastener 320 (for example, a snap) on a forward side or underside of first release strap 300 is attached to a cooperating fastener 140 (for example, a cooperating snap) on a forward side or underside of first webbing loop 120 of support pad 100. In a number of embodiments, cooperating directional snaps were used to assist in preventing unintentional disengagement. The above actions are repeated for second release strap 300*a*.

After attachment of second release strap 300*a* in the manner described above for first release strap 300, strap 372 of connector system 370 may be passed under retainer straps 110 and 110*a* to place the waist belt assembly of support pad 100 and waist belt 80 in operative connection with back plate 40. Via slots 112 and 112*a*, retainer straps 110 and 110*a* cooperate with first and second release straps 300 and 300*a*, respectively, to form a releasable connection therewith which prevents disconnection until release straps 300 and 300*a* are actuated by the user as further described below.

In the illustrated embodiments, the second section of the first release strap 300 is connected to back plate 40 via back plate connector 312 (for example, a tri-bar buckle) which passes through a slot 48 in back plate 40 in a similar manner to that described above in connection with connectors 372 and 372*a* and slots 42 and 42*a*, respectively. Further, second end 330 of first release strap is placed in operative connection with (for example, passed through) an adjustment buckle 26 of left shoulder strap 24. Likewise, a second section of second release strap 300*a* is connected to back plate 40 via back plate connector 312*a* (for example, a tri-bar buckle) which passes through a slot 48*a* in back plate 40 in a similar manner to that described above in connection with connectors 372 and 372*a* and slots 42 and 42*a*, respectively. Moreover, a second end 330*a* of second release strap 300*a* is placed in operative connection with (for example, passed through) an adjustment buckle 26*a* of left shoulder strap 24. In the illustrated embodiments, the second sections of first and second release straps 300 and 300*a* are folded at a 90 degree angle and sewn at the fold so that second ends 330 and 330*a* extend upward from the remainder of first and second release straps 300 and 300*a*, respectively.

A user may first grasp and apply force to first ends 302 and 302*a*, respectively, of first and second release straps 300 and 300*a*, respectively, to actuate release straps 300 and 300*a* to release the assembly of support pad 100 and waist belt 80 from connection with back plate 80. First ends 302 and 302*a* may, for example, include sections 303 and 303*a*, respectively, of reflective or otherwise readily visible material to enable the user to locate first ends 302 and 302*a*. Upon grasping first ends 302 and 302*a*, the user pulls first ends 302 and 302*a* in a laterally outward direction to disconnect fasteners 320 and 320*a* from cooperating fasteners 140 and 140*a*, respectively. The laterally outward force applied to first ends 302 and 302*a* will not, however, cause hook-and-loop type fasteners 310 and 310*a* to disconnect from cooperating hook-and-loop type fasteners 138 and 138*a* (or other directional connectors—that is, connectors that require application of force in a defined range of directions to effect disconnection), and release straps 300 and 300*a* cannot be fully actuated/released merely by applying a laterally outward force to first ends 302 and 302*a*, respectively, thereof. To fully actuate release straps 300 and 300*a*, the user must pull first ends 302 and 302*a* in a rearward direction, away from back plate 40, to first disconnect hook-and-loop type fasteners 310 and 310*a* of the first sections thereof from cooperating hook-and-loop type fasteners 138 and 138*a* and then to pull releasable connectors 304 and 304*a* through slots 112 and 112*a*, respectively. Separation of fasteners 320 and 320*a* from cooperating fasteners 140 and 140*a* thus requires a first action (application of force in a laterally outward direction), while separation of hook-and-loop type fasteners 310 and 310*a* from cooperating hook-and-loop type fasteners 138 and 138*a* and separation of releasable connectors 304 and 304*a* from slots 112 and 112*a* and slots 132 and 132*a* requires a second, different action (application of force in a rearward direction). As discussed above, requiring separate and different actions by the user to effect release can assist in preventing unintentional release.

In the illustrated embodiments, first sections of release straps 300 and 300*a* are maintained in close proximity or contact with support pad 100 of the waist belt assembly between connectors 304 and 304*a* and first ends 302 and 302*a* via one or more elements including member 130, webbing loops 126 and 126*a*, cooperating hook-and-loop fasteners 138 and 138*a* and fasteners 140 and 140*a* of webbing loops 120 and 120*a*. Maintaining release straps 300 and 300*a* in close proximity or contact with support pad 100 of the waist belt assembly between connectors 304 and 304*a* and first ends 302 and 302*a* assists in preventing snagging of one or both of release straps 300 and 300*a* and associated unintentional actuation/release during normal use of harness system 20.

Lengths of the second sections of release straps 300 and 300*a* between connectors 304 and 304*a* and back plate connectors 312 and 312*a* are also maintained in close proximity with support pad 100 via one or more elements including member 130 and webbing loops 126 and 126*a*. Further, connection of back plate connectors 312 and 312*a* to back plate 40 assists in preventing force applied to the second sections of first and second release straps 300 and 300*a* via, for example, snagging thereof between release connectors 304 and 304*a* and second ends 330 and 330*a* from effecting release. Moreover, even if back plate connectors 312 and 312*a* were to be disconnected from back plate 40, the position of stitching 306 and 306*a* in the sewn folds of releasable connectors 304 and 304*a* prevents a tensile force applied to the second sections of release straps 300 and 300*a* from causing releasable connectors 304 and 304*a* from being pulled through slots 112 and 112*a* and slots 132 and 132*a*, respectively. Such a tensile force results in a flattening of the sewn folds of releasable connectors 304 and 304*a* against retainer straps 110 and 110*a*, preventing releasable connectors 304 and 304*a* from passing through slots 112 and 112*a* and slots 132 and 132*a*.

As described above, relatively close contact is preferably maintained between the waist belt assembly and any portion of release straps 300 and 300*a* over which force can be applied to cause separation to effect release. Gaps between release strap 300 and 300*a* provide areas over which snagging can occur. Cooperating hook-and-loop-type connectors or fasteners 310, 310*a* and 138, 138*a* assist in maintaining such close contact over a length of release straps 300 and 300*a* while also providing a directionally limited mode of separation/release. In a number of embodiments, release elements such as release straps 300 and 300*a* hereof are formed in a manner to eliminate areas or sections that increase the likelihood of snagging. For example, release straps 300 and 300*a* do not include loops or other sections which extend from the waist belt assembly to provide a snagging hazard.

FIG. 7 illustrates harness system 20 after actuation of release straps 300 and 300*a* to release the assembly of support pad 100 and waist belt 80 therefrom. As illustrated in FIG. 7, the cooperation of back plate connectors 312 and 312*a* with slots 46 and 46*a*, respectively, and the cooperation of second ends 330 and 330*a* with adjustment buckles 26 maintain release straps 300 and 300*a* in connection with back plate 40 after release of the assembly of support pad 100 and waist belt 80. After actuation/release of release straps 300 and 300*a*, the user may, for example, simply remove shoulder straps 24 to remove harness system 20 and any equipment associated therewith.

FIG. 8 illustrates the use of the waist belt assembly of support pad 100 and waist belt 80 used in connection with a connector system 370' which includes a strap 372' formed in a loop with a single connector 374' attached thereto. Connector 374' may, for example, be a tri-bar buckle element which cooperates with a slot formed in back plate 40 as described above in connection with connectors 374 and 374*a*. In the illustrated embodiment, during installation, right or second retainer strap 110*a* is routed through the loop of connector system 370' before passing the sewn fold of releasable connector 304*a* through slot 112*a*.

The foregoing description and accompanying drawings set forth the preferred embodiments of the invention at the present time. Various modifications, additions and alternative designs will, of course, become apparent to those skilled in the art in light of the foregoing teachings without departing from the scope of the invention. The scope of the invention is indicated by the following claims rather than by the foregoing description. All changes and variations that fall within the meaning and range of equivalency of the claims are to be embraced within their scope.

What is claimed is:

1. A harness system comprising:

a waist belt assembly;

a first releasable retainer attached to the waist belt assembly, shoulder straps, a back plate connected to the shoulder straps, and a release system comprising at least a first release strap connected to and extending from the back plate, the first release strap comprising a first section, a second section at least a first releasable connector in operative connection with the first releasable retainer, the second section of the first release strap being connected to the back plate, the first section of the first release strap being on the other side of the first releasable connector from the second section, the first section of the first release strap comprising a first fastener in the vicinity of an end of the first section of the first release strap releasably connecting the first section of the first release strap to the waist belt assembly and a second fastener between the end of the first section of the first release strap and the first releasable connector connecting the first section of the first release strap to the waist belt assembly, the first fastener requiring application of force in a first direction by the user to the end of the first section of the first release strap to disconnect the first fastener from connection with the waist belt assembly, the second fastener requiring application of force in a second direction, different from the first direction, by the user to disconnect the second fastener from connection with the waist belt assembly, each of the first fastener and the second fastener being required to be disconnected from connection with the waist belt assembly before the first releasable connector can be disconnected from operative connection with the first releasable retainer so that the first releasable retainer becomes disconnected from connection with the back plate and the back plate can be removed by a user while the waist belt assembly remains worn by the user.

2. The system of claim 1 wherein continued application of force in the second direction after disconnection of the second fastener from the waist belt assembly results in disconnection of the first releasable connector from operative connection with the first releasable retainer.

3. The system of claim 2 wherein the second fastener comprises a length of a hook-and-loop-type fastener on the first section of the first release strap which cooperates with a first length of hook-and-loop-type fastener on the waist belt assembly, a generally rearward force on the first section of the first release strap being required to disconnect the second fastener from connection with the waist belt assembly.

4. The system of claim 3 wherein the first releasable connector is passed through a passage in the first releasable retainer to operatively connect the first releasable connector to the first releasable retainer and pulled through the passage in the first releasable retainer in an opposite direction to disconnect the first releasable connector from operative connection with the first releasable retainer.

5. The system of claim 4 wherein the first releasable connector comprises a sewn fold in the first release strap.

6. The system of claim 5 wherein the first releasable retainer comprises a first retainer strap attached at a first end thereof to the waist belt assembly, the first retainer strap being adapted to pass through a back plate connector connected to the back plate.

7. The system of claim 1 further comprising a second releasable retainer attached to the waist belt assembly and a second release strap connected to and extending from the back plate, the second release strap comprising at least a second releasable connector in operative connection with the second releasable retainer so that application of force to the second release strap causes disconnection of the second releasable connector from operative connection with the second releasable retainer so that the second releasable retainer becomes disconnected from connection with the back plate and the back plate can be removed by a user while the waist belt assembly remains worn by the user after disconnection of both the first releasable retainer and the second releasable retainer from connection with the back plate.

8. The system of claim 5 further comprising a second releasable retainer attached to the waist belt assembly and a second release strap connected to and extending from the back plate, the second release strap comprising at least a second releasable connector in operative connection with the second releasable retainer so that application of force to the second release strap causes disconnection of the second releasable connector from operative connection with the second releasable retainer so that the second releasable retainer becomes disconnected from connection with the back plate and the back plate can be removed by a user while the waist belt assembly remains worn by the user after disconnection of both the first releasable retainer and the second releasable retainer from connection with the back plate.

9. The system of claim 8 wherein the second release strap comprises a second section on one side of the second releasable connector, the second section of the second release strap being connected to the back plate, and a first section on the other side of the second releasable connector, the first section of the second release strap being releasably connected to the waist belt assembly.

10. The system of claim 9 wherein the first section of the second release strap comprises a first fastener in the vicinity of an end of the first section of the second release strap connecting the first section of the second release strap to the waist belt assembly and a second fastener between the end of the first section of the second release strap and the second releasable connector connecting the first section of the second release strap to the waist belt assembly, the first fastener of the second release strap requiring application of force in a first direction by the user to the end of the first section of the second release strap to disconnect the first fastener of the second release strap from connection with the waist belt assembly, the second fastener of the second release strap requiring application of force in a second direction, different from the first direction, by the user to disconnect the second fastener of the second release strap from connection with the waist belt assembly, each of the first fastener of the second release strap and the second fastener of the second release strap being required to be disconnected from connection with the waist belt assembly before the second releasable connector can be disconnected from operative connection with the second releasable retainer.

11. The system of claim 10 wherein continued application of force in the second direction after disconnection of the second fastener of the second release strap from the waist belt assembly results in disconnection of the second releasable connector from operative connection with the second releasable retainer.

12. The system of claim 11 wherein the second fastener of the second release strap comprises a length of a hook-and-loop-type fastener on the first section of the second release strap which cooperates with a second length of hook-and-loop-type fastener on the waist belt assembly, a generally rearward force on the second section of the second release strap being required to disconnect the second fastener of the second release strap from connection with the waist belt assembly.

13. The system of claim 12 wherein the second releasable connector is passed through a passage in the second releasable retainer to operatively connect the second releasable connector to the second releasable retainer and pulled through the passage in the second releasable retainer in an opposite direction to disconnect the second releasable connector from operative connection with the second releasable retainer.

14. The system of claim 13 wherein the waist belt assembly further comprises a descent system comprising a descent line stowed within the waist belt assembly.

15. The system of claim 14 wherein the back plate is adapted to connect an SCBA air tank thereto.

16. The system of claim 15 wherein the first release strap is positioned on a first side and the second release strap is positioned on a second, opposite side.

17. A system comprising:

a harness system comprising shoulder straps and a back plate connected to the shoulder straps;

a waist belt assembly;

a first releasable retainer attached to the waist belt assembly, and a release system comprising at least a first release strap comprising at least a first releasable connector in operative connection with the first releasable retainer so that application of force to the first release strap causes disconnection of the first releasable connector from operative connection with the first releasable retainer so that the first releasable retainer becomes disconnected from connection with the back plate of the harness system and the harness system can be removed by a user while the waist belt assembly remains worn by the user, the first release strap further comprising a first fastener in the vicinity of an end of the first release strap connecting the first release strap to the waist belt assembly and a second fastener between the end of the first release strap and the first releasable connector connecting the first release strap to the waist belt assembly, the first fastener requiring application of force in a first direction by the user to the end of the first release strap to disconnect the first fastener from connection with the waist belt assembly, the second fastener requiring application of force in a second direction, different from the first direction, by the user to disconnect the second fastener from connection with the waist belt assembly, each of the first fastener and the second fastener being required to be disconnected from connection with the waist belt assembly before the first releasable connector can be disconnected from operative connection with the first releasable retainer.

18. The system of claim 17 wherein continued application of force in the second direction after disconnection of the second fastener from the waist belt assembly results in disconnection of the first releasable connector from operative connection with the first releasable retainer.

19. The system of claim 18 wherein the second fastener comprises a length of a hook-and-loop-type fastener on the first release strap which cooperates with a first length of hook-and-loop-type fastener on the waist belt assembly, a generally rearward force on the first release strap being required to disconnect the second fastener from connection with the waist belt assembly.

20. The system of claim 17 wherein the waist belt assembly further comprises a descent system comprising a descent line stowed within the waist belt assembly.

21. The system of claim 17 wherein the back plate is adapted to connect an SCBA air tank thereto.

* * * * *